US006886816B2

(12) United States Patent
Smith et al.

(10) Patent No.: US 6,886,816 B2
(45) Date of Patent: May 3, 2005

(54) HEAT TRANSFER CORE FOR WATER COOLING TOWER

(76) Inventors: Kenyon P. Smith, 3649 Hwy. T, Labadie, MO (US) 63055; Robert G. Smith, 4444 Hwy. 100, Labadie, MO (US) 63055

( * ) Notice: Subject to any disclaimer, the term of this patent is extended or adjusted under 35 U.S.C. 154(b) by 0 days.

(21) Appl. No.: 10/303,359

(22) Filed: Nov. 25, 2002

(65) Prior Publication Data

US 2003/0098515 A1 May 29, 2003

Related U.S. Application Data

(60) Provisional application No. 60/333,385, filed on Nov. 26, 2001.

(51) Int. Cl.[7] ..... B01F 3/04

(52) U.S. Cl. ..... 261/112.1; 261/DIG. 72; 428/179; 428/475.5

(58) Field of Search ..... 261/112.1, 112.2, 261/DIG. 72; 428/131, 134, 179, 475.5

(56) References Cited

U.S. PATENT DOCUMENTS

| | | | | |
|---|---|---|---|---|
| 2,793,017 A | * | 5/1957 | Lake | 261/112.2 |
| 2,917,292 A | * | 12/1959 | Hittrich | 261/7 |
| 3,211,219 A | * | 10/1965 | Rosenblad | 165/166 |
| 3,235,234 A | * | 2/1966 | Beaudoin | 261/24 |
| 3,286,999 A | * | 11/1966 | Zenyu | 261/30 |
| 3,475,012 A | * | 10/1969 | Britton et al. | 261/112.2 |
| 3,739,556 A | * | 6/1973 | Waters | 96/356 |
| 4,032,604 A | | 6/1977 | Parkinson et al. | |
| 4,076,771 A | | 2/1978 | Houx, Jr. et al. | |
| 4,119,140 A | | 10/1978 | Cates | |
| 4,344,899 A | * | 8/1982 | Monjoie | 261/112.2 |
| 4,374,542 A | * | 2/1983 | Bradley | 165/166 |
| 4,395,448 A | * | 7/1983 | Lefevre et al. | 428/99 |
| 4,514,202 A | | 4/1985 | Kinney, Jr. et al. | |
| 4,548,766 A | | 10/1985 | Kinney, Jr. et al. | |
| 4,579,692 A | | 4/1986 | Bugler, III et al. | |
| 4,720,358 A | | 1/1988 | Cropp | |
| 4,788,013 A | | 11/1988 | Kinney, Jr. et al. | |
| 4,801,410 A | | 1/1989 | Kinney, Jr. et al. | |
| 4,826,636 A | | 5/1989 | Kinney, Jr. et al. | |
| 5,147,583 A | | 9/1992 | Bugler, III et al. | |
| 5,283,012 A | | 2/1994 | Bugler, III et al. | |
| 5,811,035 A | | 9/1998 | Mockry | |
| 6,070,860 A | | 6/2000 | Kinney, Jr. et al. | |
| 6,221,463 B1 | * | 4/2001 | White | 428/174 |

FOREIGN PATENT DOCUMENTS

| | | | |
|---|---|---|---|
| JP | 53-18471 | * | 2/1978 |

OTHER PUBLICATIONS

RDM Products Division, Cascade Cooling Systems, "Introducing the latest in Cooling Tower Technology," 2 pages, no date.

"Marley Cooling Tower," http://marlyct.com, no date.

Marley Cooling Tower, "HVAC and Industrial Cooling Towers," 3 pages.

The Marley Cooling Tower Company, "Products and Services," 4 pages.

* cited by examiner

*Primary Examiner*—Scott Bushey
(74) *Attorney, Agent, or Firm*—Polster, Lieder, Woodruff & Lucchesi L.C.

(57) ABSTRACT

A heat transfer core for a water-cooling tower has a film fill sheet made from formed resin. The sheet then has a pattern of buttons, channels, dimples, and spacers formed on one surface of the sheet. Along the edges of the sheet, stiffening bars with spacers are formed. The sheets are positioned upright, spaced horizontally between the upper heated water and the lower cooled water reservoirs for a generally horizontal flow of cooling air across films of water flowing downwardly over the film fill sheets. The buttons, channels, and dimples direct water across the sheet to flow down in a meandering manner and to increase the length of time for water to descend the sheet and thereby maximize cooling.

14 Claims, 4 Drawing Sheets

HEAT TRANSFER CORE FOR WATER COOLING TOWER

CROSS-REFERENCE TO RELATED APPLICATIONS

A claim of priority is made based on U.S. Provisional Application No. 60/333,385, filed Nov. 26, 2001.

STATEMENT REGARDING FEDERALLY SPONSORED RESEARCH OR DEVELOPMENT

Not applicable.

BACKGROUND OF THE INVENTION

1. Field of the Invention

This invention relates to heat transfer core for water cooling towers, and especially to film fill pack having so-called film fill sheet that brings heated water into contact with flowing air for an increased time to maximize cooling of the water.

In a water cooling tower, heated water enters the tower from a source. Such heated water may be a byproduct of a manufacturing process or of an environmental cooling system, such as an air conditioning or refrigeration system. Through use of airflow, the cooling tower transfers heat from the water to the atmosphere. The cooled water then returns to the source to remove more heat in a repeating cycle. Airflow in cooling towers has two forms: cross-flow and counter flow. Cross-flowing air passes substantially laterally across the flow of the heated water. Counter-flowing air moves substantially against the flow of the heated water. A film fill sheet may operate in both airflow, situations.

2. Description of the Related Art

For many years, water cooling towers had fill packs made of horizontal bars or slats upon which heated water was splashed or sprayed to form droplets. The droplets of heated water were exposed to air forced through the cooling tower to cool the droplets. By forming the droplets, the surface area of the water increased and thus enhanced the cooling effect on the water when exposed to the forced airflow through the cooling tower. In recent years, film fill packs containing vertically positioned, horizontally spaced synthetic resin sheets have replaced the splash bars. The film fill sheets disperse the heated water into a film of water exposed to the air stream thus increasing the surface area of the water over the droplets previously formed by the splash bars. The film fill sheets replaced splash bars because of their smaller size which in turn reduced the size of the cooling tower.

U.S. Pat. No. 4,801,410 described the film fill sheet design parameters. The parameters require dispersing the water over the film fill sheets in a thin film for maximum surface area, retarding the gravitational flow of the water to expose the maximum feasible amount of the water to cooling air, providing turbulent airflow without excessive pressure drop, and resisting mineral and biological clogging. Prior art met these parameters with film fill sheets corrugated in a chevron pattern. However until the present invention, chevron patterns have been viewed as the pre-eminent surface feature for film fill sheets.

A typical chevron pattern for a film fill sheet is shown in U.S. Pat. No. 4,548,766. The chevrons, point to the side, divide the heated water and form vertical serpentine channels to slow the descent of heated water while increasing surface area. The chevron pattern appears again in the film fill sheet depicted by U.S. Pat. No. 4,809,410 where the chevrons repeat in an alternating manner thus establishing ridgelines and corresponding valleys. The serpentine channels formed by the chevron pattern define the path of the heated water and provide no opportunity for the heated water to change channels except for overtopping the chevron ridgeline.

With edges open for airflow and water passage, film fill sheets may allow cooled water to be ejected from the tower cabinet in the airflow. Ejected cooled water reduces the efficiency of the cooling tower. U.S. Pat. No. 4,801,410 shows side edges with a corrugated pattern to permit airflow while minimizing ejection of cooled water. A corrugated pattern on side edges provides the opportunity for the loss of cooled water, while an edge bar reduces that opportunity.

During operation of a water cooling tower, when film fill sheets are loaded with heated water, the film fill sheets tend to warp or bend. Such deflection of the film fill sheet reduces the cross-sectional area of the adjacent space available for passage of air. The prior art of U.S. Pat. No. 4,548,766 has developed spacers to counter the tendency for the film fill sheet to warp. The spacers reduce the unbraced length of the sheet which stiffens the sheet under heated water loading conditions. A film fill sheet attains required stiffness with spacers regularly located along the perimeter of the sheet and in the vicinity of the center of the sheet.

To maximize cooling, prior art film fill sheets were stacked to form tubular passages that guided the cooling airflow. Building on a chevron pattern, U.S. Pat. No. 4,119,140 assembles tube shaped members to exchange heat with the Atmosphere. Later, U.S. Pat. No. 5,147,583 forms tubular air passages by the cooperation of adjacent film fill sheets. The tubular passages divert the airflow and increase turbulence.

Generally, U.S. Pat. No. 4,826,636 teaches that arrangement of film fill packs effects tower efficiency yet, this patent has little detail on features for a film fill sheet. Also, prior art water cooling towers have required treatment of the cooling water to deter mineral and biological accumulations as in U.S. Pat. No. 5,147,583.

The prior art has met its intended parameters, yet the prior art did not slow the flow of heated water sufficiently to maximize cooling.

SUMMARY OF THE INVENTION

The present invention is a film fill sheet (or a group of such film fill sheets) increases the time water dwells in the surface features of the film fill sheet while the water flows downwardly over the film fill sheet. Cooling performance improves distinctly with a film sheet that has a pattern of buttons along with spacers, edge bars, channels, and dimples. The button pattern encourages the water to flow down and to divert across the film sheet in rivulets. The spacers maintain regular horizontal spacing between adjacent film fill sheets. The vertical edge bars stiffen the sheet and reduce the amount of heated water removed by the airflow. The channels link each button and direct the flow of heated water. The dimples occur at each channel intersection and provide an opportunity for the heated water to change channels.

Among the several objects and features of the present invention are:

The provision of heat transfer core for a water cooling tower having a film fill pack made of a group of film fill sheets which increase the time required for heated water to flow from an upper heated water reservoir to a lower collection reservoir thereby increasing cooling of the water;

The provision of such a film fill pack for a cooling tower in which the film fill sheets may be readily vacuum formed from sheets of suitable synthetic resin (e.g., plastic);

The provision of such a film fill pack for a cooling tower in which the button array distributes heated water across the face of a sheet;

The provision of such a film fill pack for a cooling tower in which a stack of the film fill sheets may be placed in close proximity relative to one another in the cooling tower and yet in which the sheets remain positively spaced from one another to insure the uniform flow of forced air therebetween, maximizing cooling efficiency;

The provision of such a film fill pack for a cooling tower such that the edge bars and spacers in cooperation prevent warping of the film fill sheet and reduce the amount of water ejected from the film fill pack;

The provision of such a film fill pack for a cooling tower wherein the sheets resist the accumulation of mineral and biological deposits on their surface as water is cooled thereon;

The provision of such a film fill pack for a cooling tower which is easy to manufacture and to assemble within the cooling tower, which is impervious to the exposure of cooling water for an extended period of time, and which reduces the size of the cooling tower for an equivalent cooling capacity, as compared with prior art cooling towers; and The provision of such a film fill pack for a cooling tower such that the film fill pack may be maintained and replaced with a minimum of cost, skill and experience.

Briefly stated, the present invention relates to a film pack comprising a plurality of spaced fill sheets for use in a cooling tower for cooling water. The cooling tower has an upper reservoir for receiving heated water to be cooled, and a lower reservoir for receiving the cooled water. A fill pack comprising a plurality of fill sheets is installed between upper and lower reservoirs for directing the flow of water from the upper to the lower reservoir with the fill sheets being positioned substantially vertically. A blower draws or forces air laterally between the fill sheets so as to cool the water flowing down the fill sheets. Each of the film fill sheets has a plurality of buttons extending outwardly from one surface of the fill sheet. The buttons are arranged in rows with the buttons in each row being substantially uniformly spaced from one another with spaces therebetween. The buttons of one row are substantially in register with the spaces in the rows immediately above and below the one row. Upon release of heated water to be cooled from the upper reservoir so as to flow down the sheets, the buttons of a first row divide the heated water into rivulets flowing downwardly within the spaces between a first row of the buttons and then encountering the buttons in the next lower row so as to divert the rivulets substantially laterally into the spaces of a second row, and thence the water flows downwardly within the spaces of a second row. Upon encountering the buttons of a third row, the flowing water is diverted to the spaces between the buttons of a third row and so on as the water flows downwardly on the surface of the sheet. This diversion of flowing water inhibits the rate or speed at which the water descends from the upper to the lower reservoir and thereby maximizes the length of time that the water is exposed to the cooling airflow as the water flows from the upper to the lower reservoir and thus maximizes the cooling effect of the air passing over the fill sheets.

BRIEF DESCRIPTION OF THE DRAWINGS

Corresponding reference characters indicate corresponding part; throughout the several views of the drawings.

DESCRIPTION OF THE PREFERRED AND THE ALTERNATE EMBODIMENTS

Figure 1:
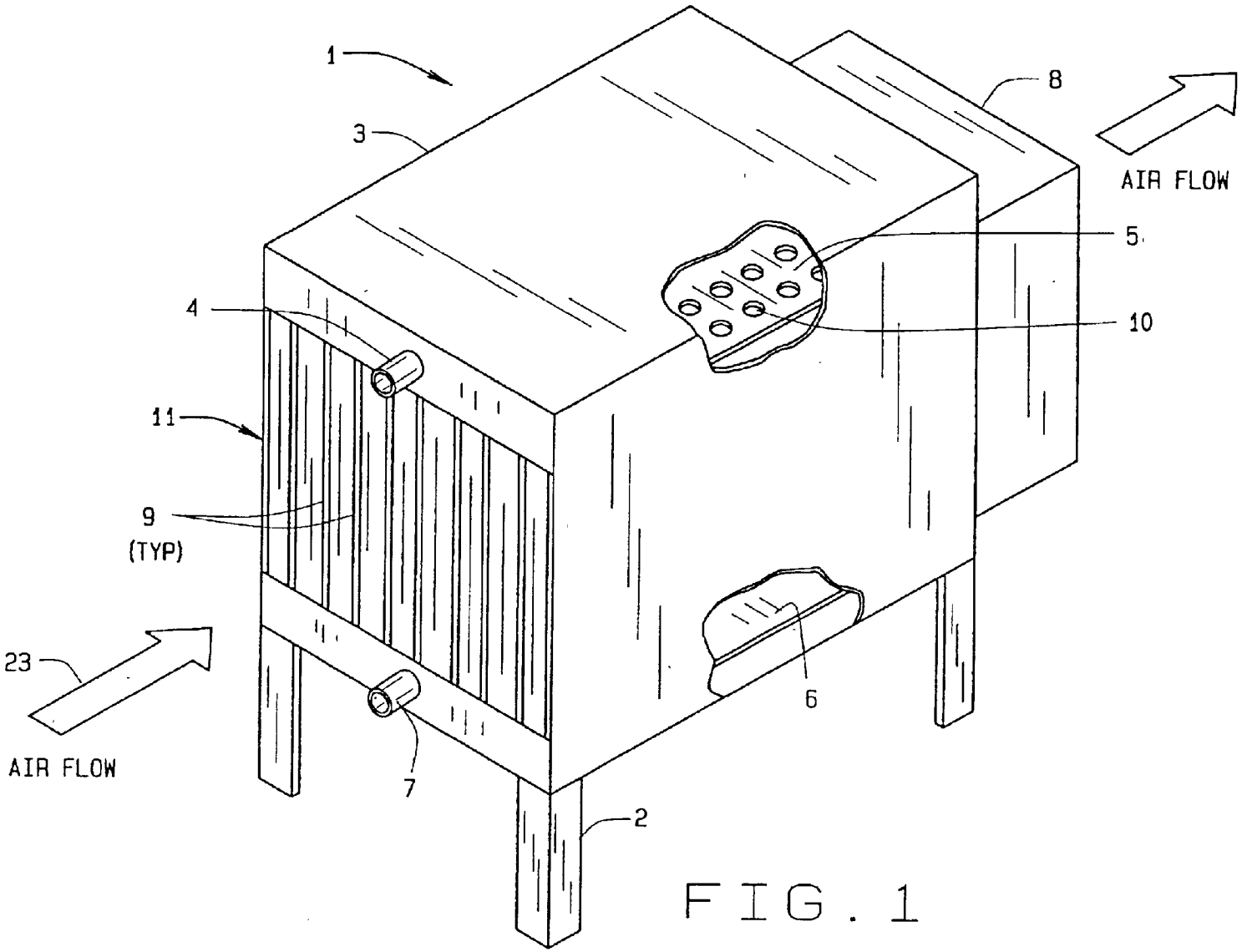
FIG. 1 is a perspective view of a typical self-contained water cooling towel having a fill pack of the present invention therein for cooling water from an air conditioning or industrial process.

Referring to the drawings, FIG. 1 shows a cooling tower 1 which receives heated water from an industrial, an air conditioning, or a refrigeration application so as to cool the water. The cooling tower cools the heated water by means of exposing the heated water to air drawn or forced through the cooling tower and then returning the cooled water to the industrial, air conditioning, or refrigeration application. The cooling tower 1 has a frame 2, a cabinet 3, a heated water inlet 4, an upper heated water reservoir 5, a lower cooled water reservoir 6, a cooled water outlet 7, and a blower 8. The frame 2 has legs or channels that attach the cooling tower 1 to a foundation, typically a roof. The legs, in the alternative, could be in the form of a bent sheet or removed completely. In this invention, a cooling tower 1 has a film fill pack 11 of the present invention disposed within a cabinet 3 between the reservoirs 5 and 6 for directing a flow of heated water from the upper heated water reservoir 5 to the lower cooled water reservoir 6 and for exposing the water flowing thereover to air being drawn through the cooling tower by a blower 8 thereby cooling the water.

As shown in FIG. 1, cabinet 3 is closed on two sides so as to contain the heated water and the film fill pack 11. In addition, the cabinet 3 has both ends partially open (i.e., covered by a grill or the like) for airflow through the cabinet. The cabinet 3 may also take the form of a box. The film fill pack 11 is a group of more than one (i.e., a plurality) of film fill sheets 9 stacked vertically together typically substantially filling the interior of the cabinet. The film fill sheets preferably comprise nylon sheet material or high-density polyethylene. The inlet 4 receives heated water from the application and sends the heated water to the upper reservoir 5. The upper reservoir 5 substantially uniformly distributes heated water to the upper edges of the film fill sheets 9 of the film fill pack 11 inside of the cabinet 3. The floor of the upper reservoir 5 has a series of outlet openings 10 extending in rows in register with a respective fill sheet 9 so as to allow water to be distributed within the upper reservoir to flow in a controlled fashion onto the front surface of its respective fill sheet to flow down the fill sheet in a controlled fashion in a manner as will appear so as to be effectively cooled in accordance with this invention. As the heated water descends down the film fill sheets 9, it is exposed to the air forced or drawn by the blower 8 through the cabinet and the heated water is thus cooled. The blower 8 could be of any desired type, such as an impeller or centrifugal blower, depending on the application. At the bottom of the film fill sheets 9, the lower reservoir 6 collects the cooled water as it flows from the bottom of the fill sheets. The outlet 7 receives cooled water from the lower reservoir 6 and returns the cooled water to the application. On the back end of the cabinet 3, blower 8 is shown to be mounted so as to draw air in a generally horizontal direction (as shown by the airflow arrow 23 in FIG. 1) through the cabinet 3 and between the film fill sheets 9. Preferably, the air is forced through the cooling tower in a direction parallel to the plane of the fill sheets. The drawn or forced airflow 23 cools the heated water as the later flows downwardly over the vertical surface of the film fill sheets 9 as the airflow moves parallel to the cabinet 3 panels, across the surface of the film fill sheets 9, and then exits the cabinet 3.

Figure 2:
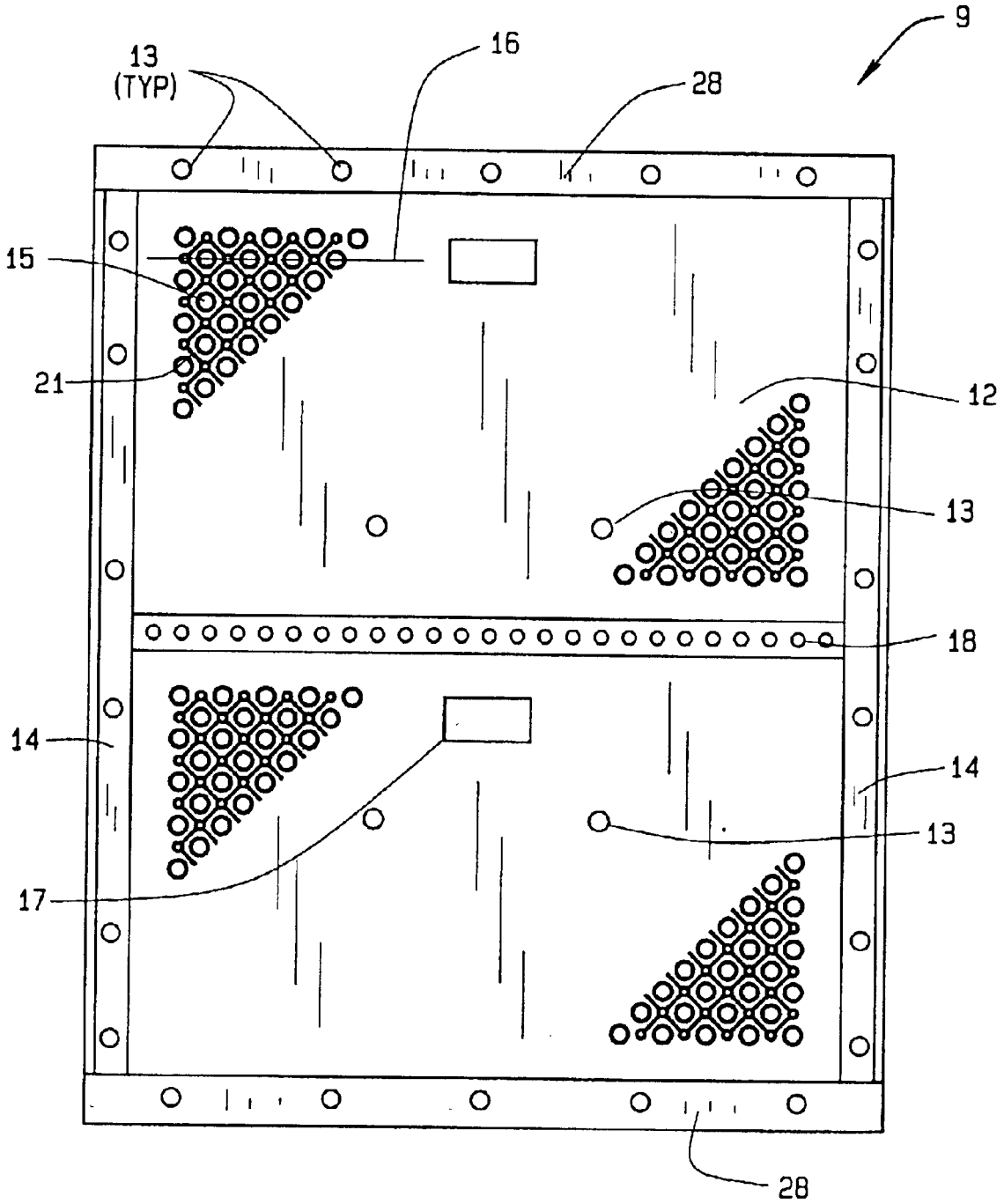
FIG. 2 a elevation view of a single film fill sheet of the present invention.

FIG. 2 depicts a single film fill sheet 9 of the present invention. Preferably, each fill sheet 9 is vacuum formed of a single sheet of suitable thermoplastic material, such as a sheet of PVC or ABS plastic resin. The sheet of a thickness so as to be relatively stiff (i.e., not limp), but within the broad aspects of this invention, the sheet may be of any desired thickness so long as it has sufficient strength to maintain its shape as it is installed in the film fill pack. The film fill sheets 9 preferably have a thickness from about 0.010 inches to about 0.025 inches [0.025 to 0.063 cm]. Typically, a sheet has a broad surface 12 markedly thinner than its length and width. The sheet thickness is the smallest dimension of the material measured prior to forming of the film fill sheet 9. Prior to forming, the surface 12 of the film fill sheet 9 forms a flat plane, and during forming (e.g., thermoforming), structural features are formed which are raised or depressed with respect to the flat plane of the sheet. On each film fill sheet 9, a plurality of spacers 13 are provided. Preferably, each of the spacers has a height of no more than 1.00 inch [2.54 cm] and a diameter of no less than 0.50 inch [1.27 cm]. As shown in the drawings, these spacers may take the form of raised cylinders with a squared top edge. These spacers may be located in the vicinity of the center of a film fill sheet 9 and along the edge bars 14 and 28 of a film fill sheet 9 so that when the sheets are stacked in close proximity to form the fill pack 11, the spacers 13 separate and space adjacent film fill sheets 9. It will be appreciated, however, that the spacers may take forms other than that described above and shown in the drawings.

Each fill sheet 9 further includes edge bars 14 and 28 which are of a raised shape extending along the perimeter edges or margins of the fill sheet for retaining the water flowing downwardly on the sheet and to prevent the water from escaping laterally of the fill sheet. The edge bars 14 and 28 also aid in aligning the adjacent fill sheets relative to one another when forming the fill pack. The edge bars also serve to at least partly stabilize the sheets relative to one another when forming the fill pack. Each of the bars 14 and 28 may be formed in a trapezoidal shape no more than 1.00 inch [2.54 cm] in height along the left and right edges of a sheet. Alternatively, each of the bars may be formed in a U-shape no more than 1.00 inch [2.54 cm] in depth along the top and bottom edges of a sheet.

Figure 3:
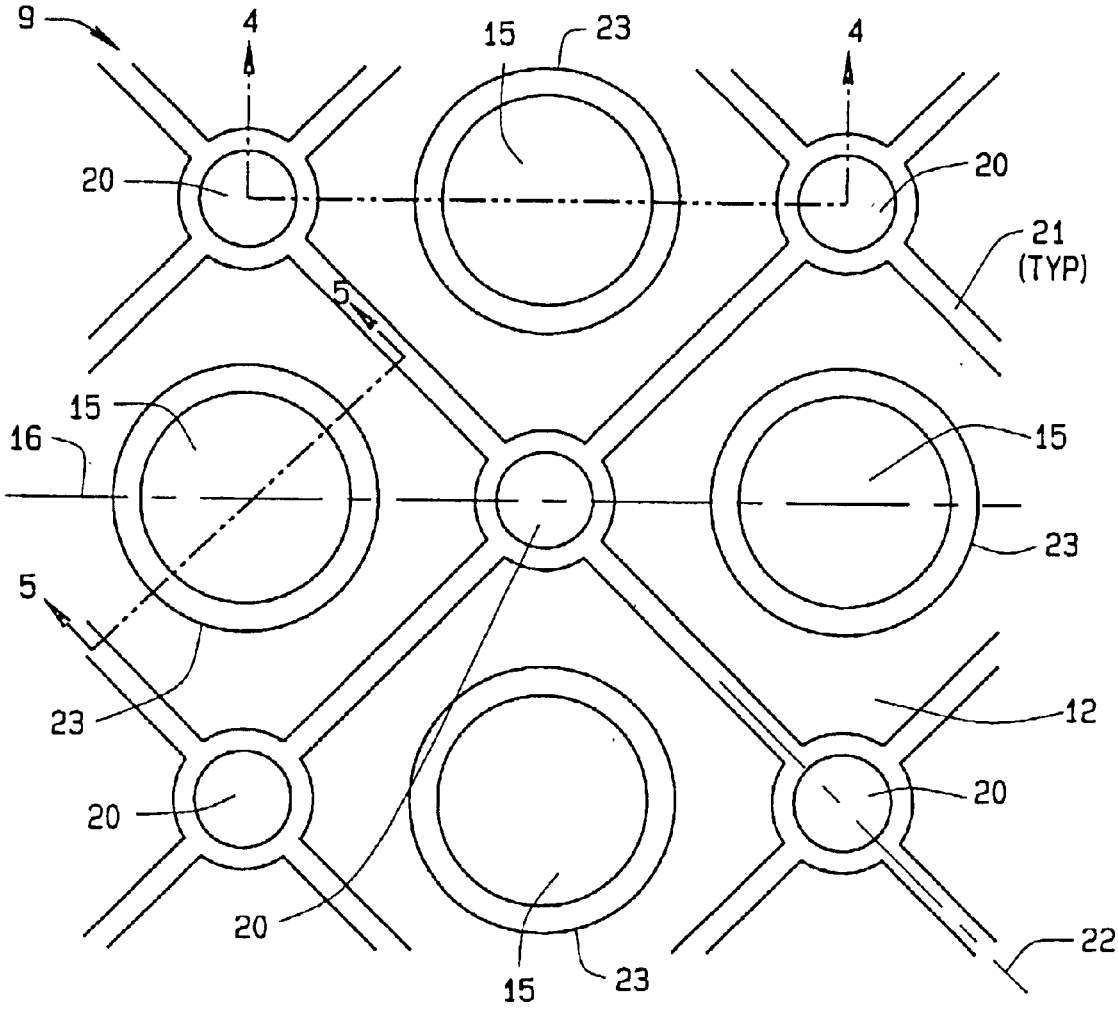
FIG. 3 is an enlarged fragmentary plan view of a typical four-button pattern and its surrounding features formed in a thick film fill sheet of the present invention which comprises the fill pack with the topmost button being in a first row, with the intermediate two buttons being of a second row, and with the bottommost button being of a third row.
Figure 4:
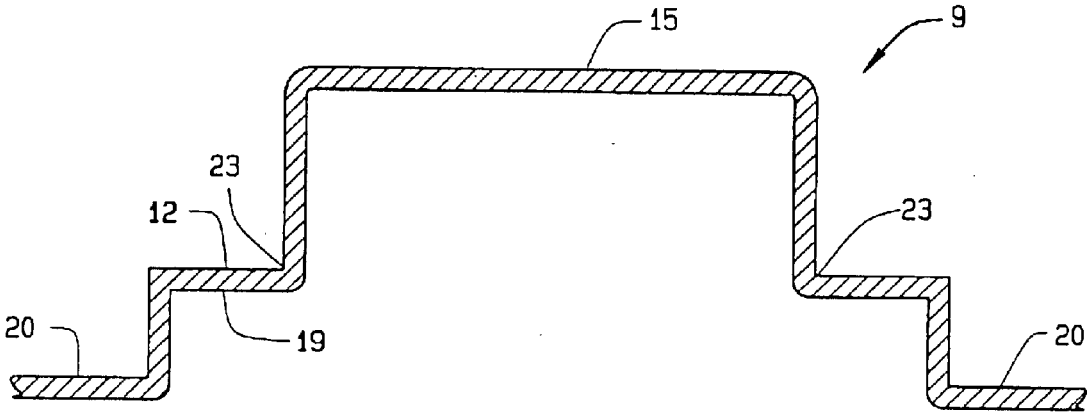
FIGS. 4 and 5 are cross-sectional views on an enlarges scale of a single button and its adjacent features.
Figure 5:
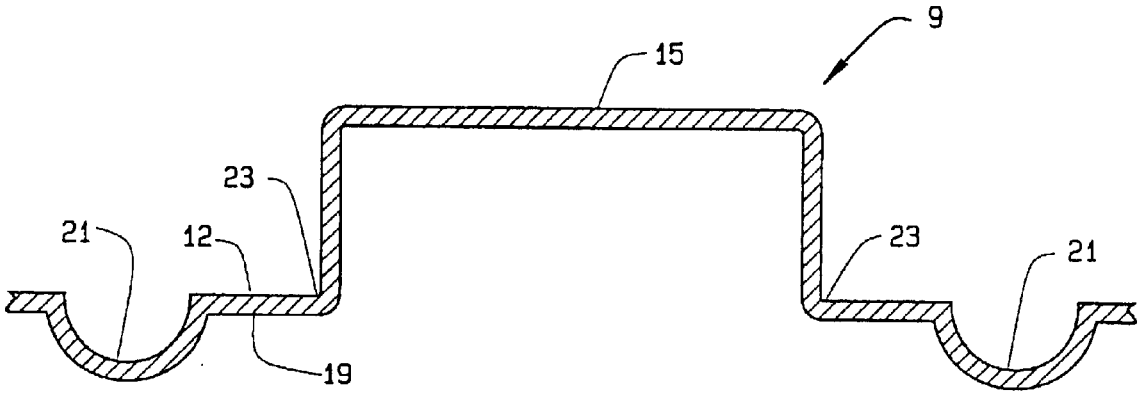

Each film fill sheet 9 includes a plurality of buttons 15 distributed substantially uniformly over the surface of the sheet with the buttons spaced from one another for purposes as will appear. Each button is shown to be a raised cylinder with a rounded top edge, as shown in FIGS. 4 and 5. On one face of the fill sheet, each button 15 extends outwardly generally perpendicular to the plane of the sheet surface 12. Buttons 15 may be arranged in generally horizontal rows 16 with the buttons in each row being uniformly spaced from one another. The buttons preferable have a diameter ranging between about 0.20 and about 0.60 inches [0.508 to 1.52 cm] and spaces between said buttons range from about 0.40 to about 0.60 inches [1.01 to 1.52 cm]. As best shown in FIG. 3, in each row 16, buttons 15 alternate with so-called dimples 20 which are smaller in diameter than the buttons. Dimples 20 are interconnected by means of diagonal channels 21 which slope at an angle of about 45° to the horizontal. Each sheet may have one or more rectangular openings l7 completely through the sheet thickness. At the middle of the film fill sheet 9 is a line 18 which is a row 16 without buttons 15 parallel to the bottom of the sheet. It will be appreciated that by vacuum forming the fill sheet, the various buttons 15, dimples 20, and channels 21 may be formed simultaneously.

During operation, the upper reservoir 5 (FIG. 1) uniformly distributes the heated water to be cooled to all of the sheets 9 forming fill pack 11 and slowly releases the heated water at a predetermined rate to descend by gravity for contact with the upper reaches of each of the fill sheets 9 which are arranged in a stack. This allows the water to flow downwardly over the fill sheets. As the heated water flows downwardly over the surface of the fill sheets 9 in between the buttons 15 (FIG. 2), the heated water flows in rivulets or small streams, preferably, but not necessarily flowing in channels 21. The rivulets are formed by the dividing actions of the buttons 15. In the present invention, as the heated water flows downwardly over the surface of the fill sheets, the water encounters the buttons 15 and/or the dimples 20 of the row immediately below (see FIGS. 2 and 3) on the fill sheet such buttons and dimples of the row below re-divide or re-direct the direction of the rivulets laterally and direct the flowing water into other flow paths, such as are provided by the inclined channels 21. The water diverts around buttons 15 and dimples 20 under the force of gravity, surface tension, and friction among other forces. Such diversions restrain and slow the flow of the water downwardly over the fill sheets thus inhibiting (slowing) the rate of descent and increasing the time that the heated water is exposed to the cooling air forced or forced through the stack of fill sheets and thus maximizing the cooling of the heated water. Water also flows as a sheet over the buttons and dimples thereby adding cooling efficiency.

FIG. 3 illustrates a front elevational view of a typical pattern on the film fill sheet 9. Each fill sheet is preferably thermoformed (vacuum formed) so as to have a three dimensional pattern of the previously described buttons 15, dimples 20, and channels 21 formed therein. The pattern begins with a button 15 which is a generally in the form of a cylinder projecting outwardly from one face of the sheet with the button having a rounded top edge. Each button 15 extends outwardly from a first or front face of the sheet surface 12. Of course, a corresponding recess is formed in the opposite face of the sheet. In each row 16 between adjacent buttons 15, a dimple 20 is formed in the row. The dimples 20 extend inwardly from the sheet surface 12 in the opposite direction as the buttons and thus forms a depression in the first or front face of sheet surface 12. Running between two dimples 20, channels 21 provide flow paths in which the heated water may flow. The channels 21 are generally arranged in a channel grid diagonal pattern 22, as shown in FIGS. 2 and 3. The channel grid pattern 22 is generally an orthogonal grid inclined obliquely with respect to the vertical. As the heated water flows downwardly, the water passes between adjacent buttons 15.

Rows of buttons 15 are formed in the sheet with the buttons 15 in each row being generally equally spaced from one another with a space therebetween. In the vertical direction, the rows are uniformly spaced in vertical direction from one another with the vertical spaced between two adjacent rows 16 of buttons being indicated by a space. The buttons 15, dimples 20, and channels 21 of one row are offset from the pattern of buttons, dimples and channels in the rows immediately above and below. Thus, as heated water from reservoir 5 (FIG. 1) is directed onto each of the fill sheets 9 and flows down each of the film fill sheets 9, as the water encounters an uppermost button 15 (FIG. 3), it is diverted laterally from its normal downward path by the button and into the channels 21 on either side of the button.

As the water exits or is discharged from an upper channel 21, it is discharged into a respective dimple 20. Then, water is discharged from its respective dimple 20 into one of two lower channels 21 connected to the recess. As the water flows down the lower channels 21, it encounters a next lower button 15 from the row of buttons below and this lower button again diverts the flow of water laterally and the process repeats itself. Thus the water takes a non-direct path to the bottom of the fill sheet as the rivulets are diverted by the buttons 15 of the various rows of buttons.

Occasionally an excessive volume of water may enter the film fill pack 11 (FIG. 1) such as from a surge of heated water or from a breach of the upper reservoir 5. That excessive volume will overtop the buttons 15 (FIG. 3) and flow directly down the film fill sheet 9 in a riffle pattern. The spacers 13 (FIG. 2) of the film fill sheet 9 allow for movement of excessive water volume substantially without restraint.

Considering a single button 15, FIG. 3 shows a button 15 and its surroundings. A single button 15 forms the basic unit repeated in the pattern on the surface 12 of the film fill sheet 9. Extending outward from the surface 12, each button 15 has a base 23 where a cylindrical portion of the button 15 flattens out at the sheet surface 12. Also, the button 15 diameter is the distance across the cylinder through the center and parallel to the sheet surface 12.

FIG. 4 illustrates a horizontal cross section of a portion of the film fill sheet 9 and shows a cross section of a button 15 and its adjacent recess 20. The section begins at the bottom of a dimple 20. Such a dimple is a depression in the surface 12 of the film fill sheet 9. The section then rises to the base 23 of the button 15 shown by the flat area atop the dimple 20. The section reaches its height at the top of a button 15.

FIG. 5 illustrates a sectional view taken along line 5—5 of FIG. 3 parallel to the channel grid diagonal pattern 22. This section begins at the bottom of a channel 21. The channel 21 acts to direct water flow. The sides 26 of the button 15 form the channels 21. Lastly, this section then reaches the top of a button 15.

Those skilled in the art will recognize that the spacing of buttons 15 on the film fill sheet 9 may vary in their spacing therebetween and that the spacing of the rows of buttons may also vary. In addition, buttons 15, recesses 20 and channels 21 may have dimensions and shapes so long as they properly redirect and divert the flow of water to be cooled as it flows down the fill sheet so as to increase the time the water is exposed to the cooling air forced through the stack of fill sheets.

Further, those skilled in the art may run water over the reverse surface 19 of the film fill sheet 9 such that water to be cooled may flow over both the front and the back face of the fill sheets. The reverse surface 19 contacted the mold during manufacture of the film fill sheet 9.

In view of the above, it will be seen that the several objects and features of this invention are achieved and other advantageous results are attained.

As various changes could be made in the above constructions and methods without departing from the scope of the invention, it is intended that all matter contained in the above description or shown in the accompanying drawings shall be interpreted as illustrative and not in a limiting sense.

What we claim is:

1. In a cooling tower for cooling water, said cooling tower having an upper reservoir to distribute heated water, a lower reservoir to receive the cooled water, a plurality of spaced film fill sheets positioned substantially upright over which the heated water to be cooled travels from said upper to said lower reservoir, and a blower for forcing air between said sheets so as to cool the water flowing down the sheets, wherein the improvement comprises:

a plurality of buttons formed thereon and extending outwardly from one surface of the sheet, said buttons being arranged in a plurality of rows with the buttons in each said row being substantially uniformly separated with spaces therebetween, said buttons of one row being offset one half the distance between two adjacent buttons from the rows immediately above and below said one row; each row having a plurality of dimples formed thereon and extending inwardly from said one surface of said sheet, said dimples in each said row being arranged between adjacent ones of said buttons with said buttons and dimples being substantially uniformly separated from one another with spaces therebetween, said dimples of one row being offset one half the distance between two adjacent buttons from the rows immediately above and below said one row, a channel on both sides of each said button with said channels extending downwardly and laterally with respect to the vertical, said dimples being located at the intersection of said channels for two such adjacent rows; and a grid pattern of channels that border each of said buttons on four diagonal sides, said channels connect the base of said buttons and said dimples such that upon releasing heated water to be cooled from said upper reservoir so as to flow down said sheets, said water upon encountering a first row of buttons and dimples is divided into rivulets flowing downwardly within said spaces between said buttons, said channels and said dimples of said first row of said buttons wherein as said water flows downwardly from said first row, said water encountering said buttons and said dimples in the next lower or second row so as to divert the flow of said water in a meandering manner into said spaces and said channels of said second row, and thence said water will flow downwardly within said spaces, said channels, and said dimples of said second row, wherein as said water flows downwardly from said second row, said water encounters said buttons, said dimples, and said channels of the next lower row so as to divert the flow of water substantially laterally into said spaces of said next row, and so on until said water flows into said lower reservoir whereby the rate at which said water flows down said sheet is inhibited thereby maximizing the length of time that said water is exposed to the flow of cooling air as said water flows from said upper to said lower reservoir.

2. A film fill sheet as set forth in claim 1 with a plurality of buttons formed thereon and extending outwardly from one surface of the sheet, said buttons being arranged in rows, said buttons in each said row being substantially uniformly separated with spaces therebetween, wherein said buttons of one row being one half the distance between two adjacent buttons from the rows immediately above and below said one row, such that upon releasing an excessive volume of heated water to be cooled from said upper reservoir, said water flows downwardly over said buttons in a riffle pattern, and thereby inhibits the rate at which said water descends from said upper to said lower reservoir, allows passage of an excessive volume of said water, and thereby maximizes the length of time that said water is exposed to the cooling airflow as said water flows from said upper to said lower reservoir.

3. A film fill sheet as set forth in claim 1, wherein each of said film fill sheets is of polyvinyl chloride sheet material.

4. A film fill sheet as set forth in claim 1, wherein each of said film fill sheets is of nylon sheet material.

5. A film fill sheet as set forth in claim 1, wherein each of said film fill sheets comprises high-density polyethylene.

6. A film fill sheet as set forth in claim 1, wherein said buttons have a diameter ranging between about 0.20 and about 0.60 [0.508 to 1.52 cm] inches and the spaces between said buttons range from about 0.40 to about 0.60 inches [1.01 to 1.52 cm].

7. A film fill sheet as set forth in claim 1, wherein the thickness of said sheets facilitates vacuum forming thereof at an appropriate temperature.

8. A film fill sheet as set forth in claim 1, wherein said film fill sheet has a thickness from about 0.010 inches to about 0.025 inches [0.025 to 0.063 cm].

9. A vacuum formed film sheet for use in a water cooling tower comprising:

an arrangement of buttons evenly separated in both horizontal and vertical directions and offset from adjacent buttons, a plurality of bars formed along the left, right, top, and bottom edges of said sheet to retain water, to provide stability, to align sheets, and, a plurality of formed spacers along the said bars and in the vicinity of the center of said sheet to separate said sheet from adjacent film fill sheets.

10. A vacuum formed film sheet as set forth in claim 9, wherein each of said bars is formed in a trapezoidal shape no more than 1.00 inch [2.54 cm] in height along the left and right edges of a sheet.

11. A vacuum formed film sheet as set forth in claim 9, wherein each of said bars is formed in a U-shape no more than 1.00 inch [2.54 cm] in depth along the top and bottom edges of a sheet.

12. A vacuum formed film sheet as set forth in claim 9, wherein each of said spacers has a height of no more than 1.00 inch [2.54 cm] and a diameter of no less than 0.50 inch [1.27 cm].

13. In a cooling tower for cooling water, said cooling tower having an upper reservoir to distribute heated water, a lower reservoir to receive the cooled water, a plurality of spaced film fill sheets positioned substantially upright over which the heated water to be cooled travels from said upper to said lower reservoir, and a blower for forcing air laterally between said sheets so as to cool the water flowing down the sheets, wherein the improvement comprises:

a plurality of buttons formed thereon and extending outwardly from one surface of the sheet, said buttons being arranged in a plurality of horizontal rows, the buttons in each said row being substantially uniformly separated with spaces therebetween, said buttons of one row being offset one half the distance between two adjacent buttons, from the rows immediately above and below said one row; a plurality of dimples formed thereon and extending inwardly, said dimples being arranged in rows, the dimples in each said row being substantially uniformly separated with spaces therebetween, wherein the dimples of one row being offset one half the distance between two adjacent buttons from the rows immediately above and below said one row, said dimples located at the intersection of four channels; and a grid pattern of channels that border each of said buttons on four diagonal sides, said channels connect the base of said buttons and said dimples such that upon releasing heated water to be cooled from said upper reservoir so as to flow down said sheets, said water upon encountering a first row of buttons and dimples is divided into rivulets flowing downwardly within the spaces between the buttons, said channels, and the dimples of said first row of said buttons wherein as said water flows downwardly from said first row, said water encountering the buttons and the dimples in the next lower or second row so as to divert the flow of water laterally left or right at random in a meandering manner into the spaces, channels, and dimples of said second row, and thence said water will flow downwardly within the spaces, channels, and dimples of said second row, wherein as said water flows downwardly from said second row, said water encounters the buttons, dimples, and channels of the next lower row so as to divert the flow of water substantially laterally left or right at random in a meandering manner into the spaces, channels, and dimples of said next row, and so on until said water flows into said lower reservoir whereby the distance traveled by said water lengthens, thus the rate at which said water flows down said sheet is inhibited thereby maximizing the length of time that said water is exposed to the flow of cooling air as the water flows from said upper to said lower reservoir.

14. A film fill sheet as set forth in claim 1 with a plurality of buttons formed thereon and extending outwardly from one surface of the sheet, said buttons being arranged in rows, the buttons in each said row being substantially uniformly separated with spaces therebetween, wherein the buttons of one row being offset one half the distance between two adjacent buttons from the rows immediately above and below said one row, such that upon releasing an average volume of heated water to be cooled from said upper reservoir, said water flows downwardly in a meandering separate lineal paths through the spaces between a first row of said buttons then said water encounters a second row of buttons, said second row of buttons diverts said water substantially laterally left or right at random in a meandering manner so that said water flows around a button in said row, into the spaces of said next row, and so on until said water flows into said lower reservoir and thereby increasing the distance traveled by said water down the film fill sheet thus, inhibiting the rate at which said water descends from said upper to said lower reservoir, allowing passage of an average volume of said water, and thereby maximizing the length of time that said water is exposed to the cooling airflow as said water flows from said upper to said lower reservoir.

* * * * *